US010874929B2

(12) United States Patent
Lamarque

(10) Patent No.: US 10,874,929 B2
(45) Date of Patent: Dec. 29, 2020

(54) ABDOMINAL WEIGHT LIFTER BELT ASSEMBLY

(71) Applicant: Matthew Lamarque, Seaside, CA (US)

(72) Inventor: Matthew Lamarque, Seaside, CA (US)

( * ) Notice: Subject to any disclaimer, the term of this patent is extended or adjusted under 35 U.S.C. 154(b) by 102 days.

(21) Appl. No.: 16/004,339

(22) Filed: Jun. 8, 2018

(65) Prior Publication Data

US 2019/0374837 A1 Dec. 12, 2019

(51) Int. Cl.

| | |
|---|---|
| ***A63B 71/00*** | (2006.01) |
| ***A41F 9/00*** | (2006.01) |
| ***A63B 21/072*** | (2006.01) |
| ***A44B 11/26*** | (2006.01) |
| ***A44B 11/24*** | (2006.01) |
| ***A44B 18/00*** | (2006.01) |

(52) U.S. Cl.

CPC ..... *A63B 71/00* (2013.01); *A41F 9/002* (2013.01); *A44B 11/24* (2013.01); *A44B 11/266* (2013.01); *A44B 18/00* (2013.01); *A63B 21/072* (2013.01); *A63B 2209/10* (2013.01); *A63B 2244/09* (2013.01)

(58) Field of Classification Search

CPC ... A63B 71/00; A63B 21/072; A63B 2209/10; A63B 2244/09; A63B 1/00; A41F 9/002; A44B 11/266; A44B 11/24; A44B 18/00; A44B 11/223

See application file for complete search history.

(56) References Cited

U.S. PATENT DOCUMENTS 1,382,446 A 12/1920 Warren
2,681,453 A * 6/1954 Lane ..... A41F 9/002 2/322
3,424,134 A 1/1969 Rosenblum
3,565,303 A 2/1971 Kippen
4,003,375 A * 1/1977 Simjian ..... A61H 23/00 601/107
4,348,774 A * 9/1982 Woodson ..... A41F 9/002 128/95.1
4,541,152 A 9/1985 DiMarco et al.
4,545,370 A * 10/1985 Welsh ..... A61F 5/028 128/95.1
4,572,167 A * 2/1986 Brunswick ..... A61F 5/028 2/44
4,638,764 A 1/1987 Anderson
4,689,833 A * 9/1987 Daniels ..... A61F 5/03 128/95.1
4,802,667 A * 2/1989 Altner ..... A61F 5/028 2/338
4,829,989 A * 5/1989 Deamer ..... A61F 5/02 602/19

(Continued)

*Primary Examiner* — Garrett K Atkinson
(74) *Attorney, Agent, or Firm* — Patrick Reilly

(57) ABSTRACT

A quick hook-up and release anchor belt assembly for adjustably interconnecting two detachably coupled belts that are especially suited in combination for constraining the abdominal portion of a weight lifter's torso, and the like, the belt being of substantial thickness. Each belt includes a flexible elongate length and optionally a rigid end portion. The belts are positionable and detachably attachable along their elongate length by means of hook and loop fasteners. A releasable toggle or connector is operable to instantly draw up or alternatively allow interconnected separation and attachment of the two end portions of the coupled belts.

18 Claims, 13 Drawing Sheets

(56) References Cited

U.S. PATENT DOCUMENTS 4,833,730 A * 5/1989 Nelson ..... A61F 5/028 2/44
4,964,401 A * 10/1990 Taigen ..... A61F 5/028 128/876
4,968,027 A * 11/1990 Anderson ..... A61F 5/028 2/322
4,984,786 A * 1/1991 Lemke ..... A63B 21/4001 482/105
5,010,850 A 4/1991 Sailer
5,036,864 A * 8/1991 Yewer, Jr. ..... A41F 9/002 128/876
5,046,488 A * 9/1991 Schiek, Sr. ..... A61F 5/028 2/338
5,065,773 A * 11/1991 Jackson ..... A63B 21/00181 128/876
5,080,045 A 1/1992 Reese et al.
5,105,806 A * 4/1992 Woodhouse ..... A61F 5/028 128/112.1
5,141,223 A * 8/1992 Block ..... A63B 21/0552 482/124
5,147,261 A * 9/1992 Smith ..... A61F 5/028 2/338
5,150,504 A 9/1992 Cohen
5,158,510 A * 10/1992 Lemire ..... A63B 21/4001 482/51
5,187,840 A 2/1993 Kaczorowski
5,279,386 A * 1/1994 Cearley ..... A62B 35/0031 119/907
5,309,572 A 5/1994 Seamans
5,316,022 A * 5/1994 Schiek, Sr. ..... A61F 5/028 128/876
5,349,706 A * 9/1994 Keer ..... A41D 13/0012 2/300
5,388,274 A * 2/1995 Glover ..... A61F 5/028 128/100.1
5,467,508 A * 11/1995 Feng ..... A44B 11/06 24/170
5,471,680 A * 12/1995 Vesterinen ..... A41D 13/0525 2/338
D366,555 S * 1/1996 Daniels ..... D24/190
5,484,395 A * 1/1996 DeRoche ..... A61F 5/028 128/100.1
5,528,771 A * 6/1996 Yudin ..... A61F 5/028 128/112.1
5,647,824 A * 7/1997 Levenson ..... A61F 5/028 2/311
D390,896 S * 2/1998 Stalnaker ..... D21/662
5,816,460 A 10/1998 Cook
D422,709 S * 4/2000 Caswell ..... D2/624
6,053,883 A * 4/2000 Schiek, Sr. ..... A61F 5/028 602/19
6,279,804 B1 8/2001 Gregg
6,419,652 B1 * 7/2002 Slautterback ..... A61F 5/028 128/96.1
6,551,221 B1 * 4/2003 Marco ..... A63B 21/0004 280/600
6,926,685 B1 8/2005 Modglin
7,077,794 B1 * 7/2006 Bray ..... A41D 13/0525 482/111
D535,443 S * 1/2007 Pineda ..... D29/100
7,200,901 B2 4/2007 Pitts et al.
7,931,571 B2 * 4/2011 Bernardoni ..... A61F 5/0102 434/255
8,192,336 B2 * 6/2012 Jacob ..... A63B 21/4009 482/121
8,192,383 B2 * 6/2012 Polliack ..... A61F 5/0193 602/19
8,591,445 B2 * 11/2013 Serola ..... A61F 5/028 602/19
8,920,351 B2 * 12/2014 Polliack ..... A61F 5/05883 128/96.1
8,926,536 B2 * 1/2015 Hopman ..... A61B 17/135 602/13
9,028,435 B2 * 5/2015 Hopman ..... A61B 17/1322 602/23
9,050,489 B2 * 6/2015 Bell ..... A63B 21/00069
9,427,238 B2 * 8/2016 Hopman ..... A61B 17/1325
9,526,966 B2 * 12/2016 White ..... A63B 71/0054
9,663,255 B2 * 5/2017 Ritola ..... B65D 63/08
9,750,632 B1 9/2017 Logan
9,808,666 B1 * 11/2017 Burkinshaw ..... A63B 71/02
9,914,012 B2 * 3/2018 Walter ..... A63B 21/4039
9,930,935 B2 * 4/2018 King ..... A44B 11/006
10,137,349 B2 * 11/2018 Deinlein ..... A63B 69/3608
10,258,347 B2 * 4/2019 Hopman ..... A61B 17/1322
10,471,296 B2 * 11/2019 Burkinshaw ..... A63B 21/4009
10,624,808 B2 * 4/2020 Hathorn ..... A61F 13/148
2002/0068667 A1 * 6/2002 Strachan ..... A63B 21/4009 482/124
2002/0092138 A1 7/2002 Spiller
2007/0158380 A1 7/2007 Calkin
2008/0103032 A1 * 5/2008 Jacob ..... A63B 21/4009 482/124
2008/0296327 A1 12/2008 Murdoch et al.
2012/0185996 A1 * 7/2012 Goldberg ..... A42B 1/004 2/160
2012/0245002 A1 * 9/2012 Todd ..... A63B 21/4013 482/124
2014/0038791 A1 * 2/2014 Bell ..... A63B 69/12 482/111
2014/0338095 A1 11/2014 Storms et al.
2019/0111298 A1 * 4/2019 Whalen ..... A61H 9/0092

* cited by examiner

ABDOMINAL WEIGHT LIFTER BELT ASSEMBLY

FIELD OF THE INVENTION

The present invention is related to athletic training devices and methods. More particularly the present invention is related to methods and devices for safely lifting and training with weights.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

The use of supportive belts for wearing around a users weight while lifting heavy weights is known in the prior art. More specifically, exercise devices heretofore devised and utilized are known to consist basically of familiar, expected and obvious structural configurations of rigid, wide and thick belt materials is known in the prior art.

While these devices fulfill their respective, particular objectives and requirements, the prior art does not disclose an exercise belt that reduces discomfort from the belt itself digging into the wearer's body during a desired full range of motion.

There is therefore a long-felt need to provide clothing and a method of use thereof that more conveniently and effectively provides a belt worn about a user's body while lifting or positioning weights.

SUMMARY AND OBJECTS OF THE INVENTION

Towards these objects and other objects that will be made obvious in light of the present disclosure, the present invention (hereinafter, "the invented belt") provides a belt formed with two components that are detachably coupled simultaneously along respective elongate sides and at one end of each component.

In one preferred embodiment of the invented belt, each component includes a flexible fabric coupled with a more rigid piece attached at one end of the respective component wherein one of two complementary attachment assembly pieces are respectively attached to one of the rigid pieces. The two complementary attachment assembly pieces are alternatively manually placed into (1.) an attached state and (2.) a detached state, whereby the invented belt are detachably attachable. The attachment assembly comprising the two complementary attachment assembly pieces may be or comprise a belt buckle assembly or other suitable belt end attachment device known in the art.

In another optional aspect of the invented belt, each fabric length may include one of a pair of complementary hook and loop fastener strips that each extend along the elongate dimension of their respective fabric length.

In an alternate preferred embodiment of the invented belt, one or more of the components do not include a rigid piece disposed between a flexible fabric and an attachment assembly piece. In yet another alternate preferred embodiment of the invented belt, one or more of the components do not include a rigid at all.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

INCORPORATION BY REFERENCE

All publications, patents, and patent applications mentioned in this specification are herein incorporated by reference to the same extent as if each individual publication, patent, or patent application was specifically and individually indicated to be incorporated by reference. U.S. Pat. No. 9,750,632 (Inventor: Logan; Charles P.; issued Sep. 5, 2017) titled "Lower back support system"; U.S. Pat. No. 9,526,966 (Inventor: White, Timothy; issued Dec. 27, 2016) titled "Weight lifting apparatus"; U.S. Pat. No. 5,647,824 (Inventor: Levenson, Bruce Adam; issued Jul. 15, 1997) titled "Weight lifter's belt incorporating strap ratchet and nylon strap"; U.S. Pat. No. 5,187,840 (Inventor: Kaczorowski, Wladyslaw; issued Feb. 23, 1993) titled "Clasp with a tape for binding, fixing, and tightening"; and U.S. Pat. No. 4,541,152 (Inventors: DiMarco; Thomas J. Di Marco; Joel E.; issued Sep. 17, 1985) titled "Quick hook-up and release buckling for weight lifter belts" are incorporated herein by reference in their entirety and for all purposes.

BRIEF DESCRIPTION OF THE FIGURES

These, and further features of the invention, may be better understood with reference to the accompanying specification and drawings depicting the preferred embodiment, in which.

DETAILED DESCRIPTION

Figure 1:
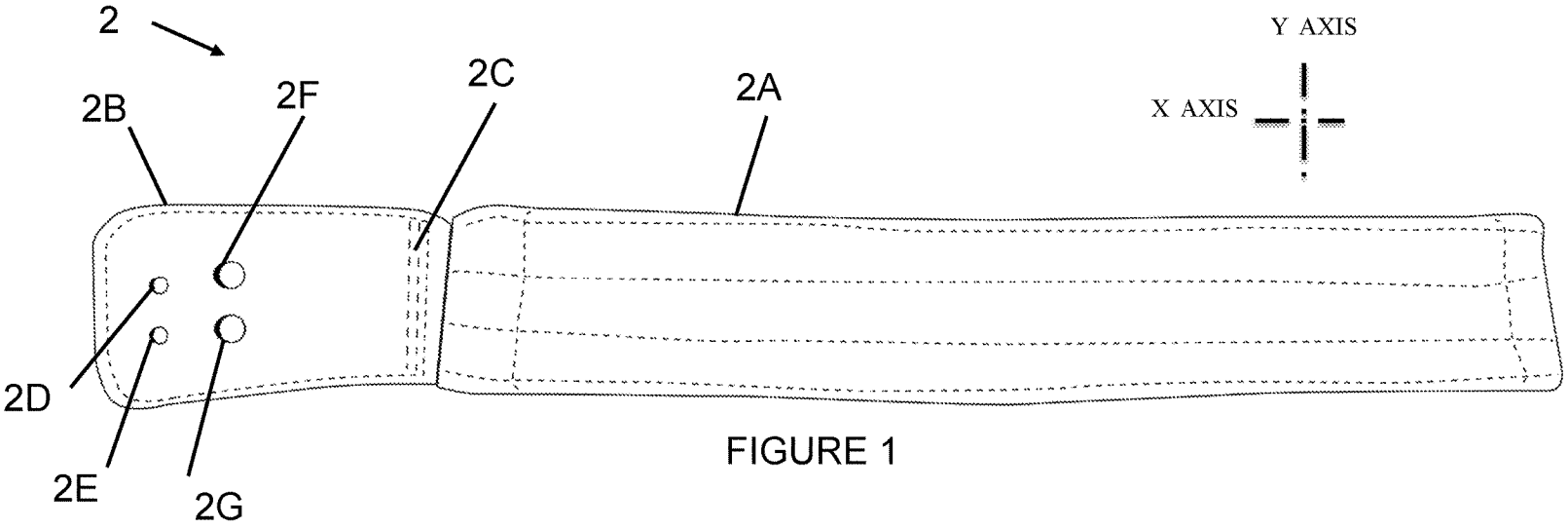
FIG. 1 is a front view of a first component of a first preferred embodiment of invented belt in a detached and isolated state.
Figure 5:
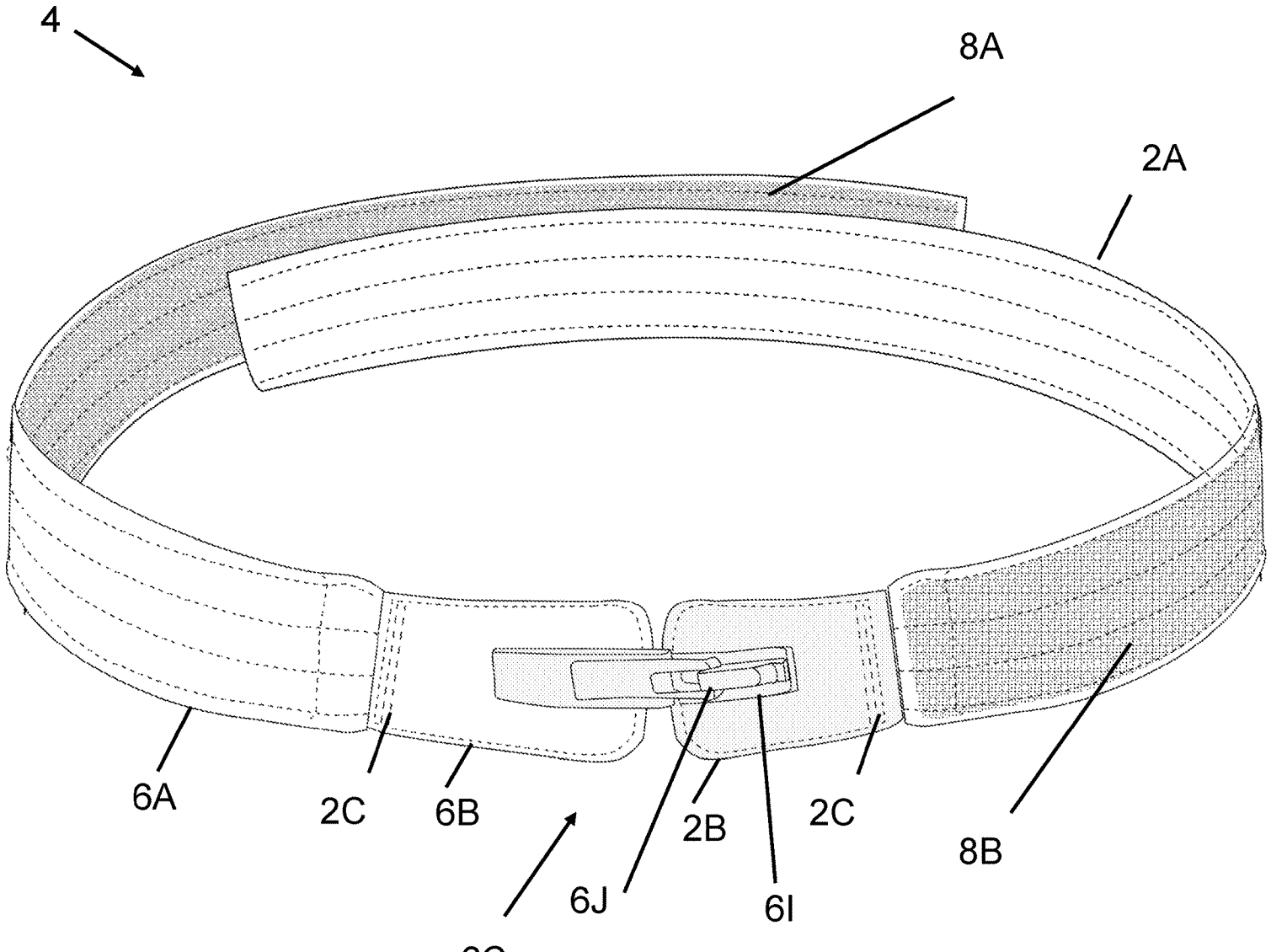
FIG. 5 is a front perspective view of the first preferred embodiment of invented belt with the first component of FIG. 1 and the second component of FIG. 2 formed into an attached state by positioning of a first toggle buckle component of FIG. 2.

Referring now generally to the Figures and particularly to FIG. 1 and FIG. 5, FIG. 1 is a front view of a first component 2 in a detached and isolated state, wherein the first component 2 is an element of a first preferred embodiment of the invented belt 4 (hereinafter, "the first belt" 4) as shown in full FIG. 5. The first component 2 includes a first fabric length 2A attached to a first rigid piece 2B. The first fabric length 2A is attached by sewn thread 2C with the first rigid piece 2B. It is understood that the first fabric length 2A may be attached with the first rigid piece 2B by other suitable attachment means known in the art.

The first rigid piece 2B is preferably three inches to four inches wide in along a Y-axis and eight inches or more along an orthogonal X-axis, and 0.25 inch thick along a Z-axis (not shown). It is understood that the Y-axis, the X-axis and the Z-axis are each mutually orthogonal to the other two axes. The first rigid piece 2B includes a pair of registration receivers 2D & 2E and a pair of hook-pin receivers 2F & 2G. The hook-pin receivers 2F & 2G each extend fully through the first rigid piece 2B and the pair of registration receivers 2D & 2E each preferably extend into or fully through the first rigid piece 2B.

Figure 2:
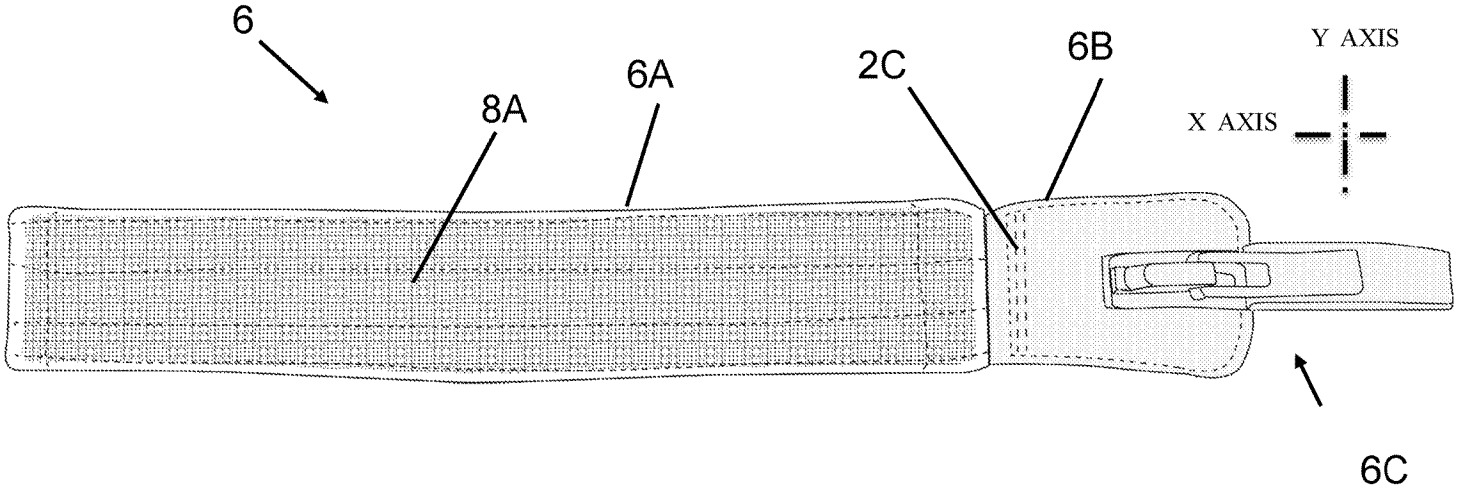
FIG. 2 is a front view of a second component of the first preferred embodiment of invented belt in a detached and isolated state.

Referring now generally to the Figures and particularly to FIG. 2, FIG. 2 is a front view of a second component 6 of the first belt 4 in a detached and isolated state. The second component 6 includes a second fabric length 6A attached to second rigid piece 6B. The second fabric length 6A is attached by sewn thread 2C with the second rigid piece 6B. It is understood that the second fabric length 6A may be attached with the second rigid piece 6B by other suitable attachment means known in the art.

It is understood that the first fabric length 2A and/or the second fabric length 6A may be or comprise rayon, polyester, an elastic stretchable organic fabric, an elastic synthetic fabric, and/or other suitable fabric known in the art in singularity or combination.

Alternatively or additionally then the first fabric length 2A and/or the second fabric length 6A my comprise the stretchable fabric provided in SUPER SQUAT CENTURION (™) power weight lifting clothing marketed by Titan Support Systems, Inc. of Corpus Christi, Tex.; the DETONATOR LEVER (™) or the DOMINATOR PRO QR (™) as marketed by Zuluglove of Toronto, Canada.

The second rigid piece 6B is preferably three inches to four inches wide in along a Y-axis, eight inches or more along an orthogonal Y-axis, and 0.25 inch thick along the Z-axis (not shown). A toggle buckle 6C is coupled x with the second rigid piece 6B.

An outward fastener fabric length 8A extends along the front side second fabric length 6A. It is understood that in various preferred alternate embodiments of the invented belt that the outward fastener fabric length 8A may be or comprise a hook type fastener fabric and/or a loop type fastener fabric.

Figure 3:
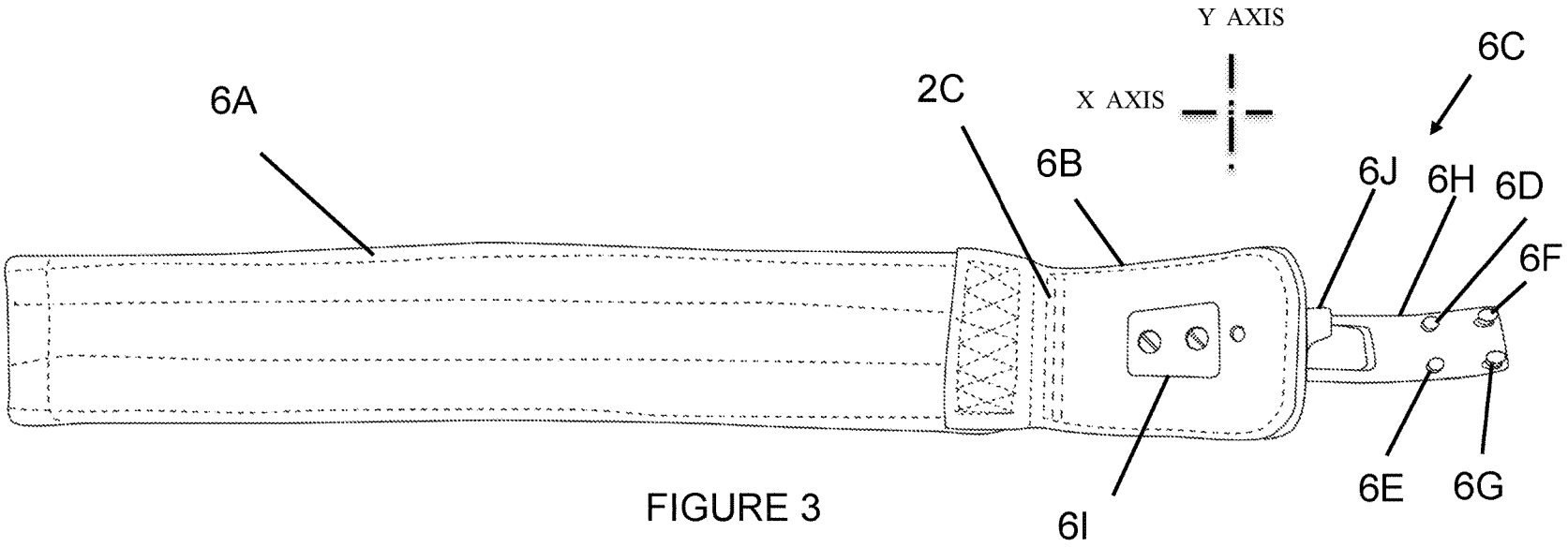
FIG. 3 is a back view of the second component FIG. 2 in a detached and isolated state.

Referring now generally to the Figures and particularly to FIG. 3, FIG. 3 is a back view of the second component 6 in a detached and isolated state. The toggle buckle 6C includes a pair of registration pins 6D & 6E and a pair of hook-pins 6F & 6G that extend from a toggle member 6H. The toggle buckle 6C further comprises an anchor 6I that is coupled with the second rigid piece 6B. A lever arm 6J of the toggle buckle 6C is disposed between and rotatably coupled with both the anchor 6I and the toggle member 6H.

It is understood that the toggle buckle 6C may comprise or be replaced with the toggle means T as disclosed in U.S. Pat. No. 4,541,152 issued to inventors Thomas DiMarco and Joel Di Marco on Sep. 17, 1985 and titled "Quick hook-up and release buckling for weight lifter belts", or other suitable hook-up and release buckling known in the art.

Figure 4:
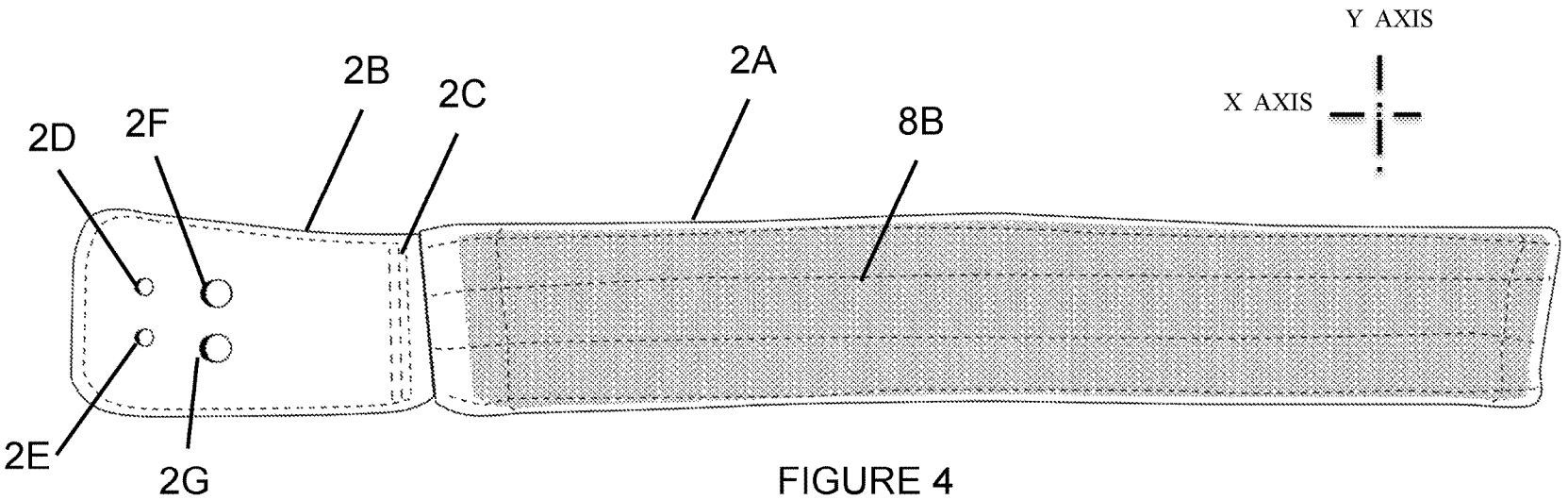
FIG. 4 is a back view of the first component FIG. 1 in a detached and isolated state.

Referring now generally to the Figures and particularly to FIG. 4, FIG. 4 is a back view of the first component 2 in a detached and isolated state. An inward fastener fabric length 8B extends along the back side of the first fabric length 2A. It is understood that in various preferred alternate embodiments of the invented belt that the inward fastener fabric length 8B may be or comprise a hook type fastener fabric and/or a loop type fastener fabric.

Referring now generally to the Figures and particularly to FIG. 5, FIG. 5 is a front perspective view of the first belt 4 with the first component 2 and the second component 6 formed into an attached state, wherein the toggle buckle 6C is engaged with the first rigid piece 2B and outward fastener fabric length 8A is engaged with and detachably coupled with the inward fastener fabric length 8B.

Figure 6:
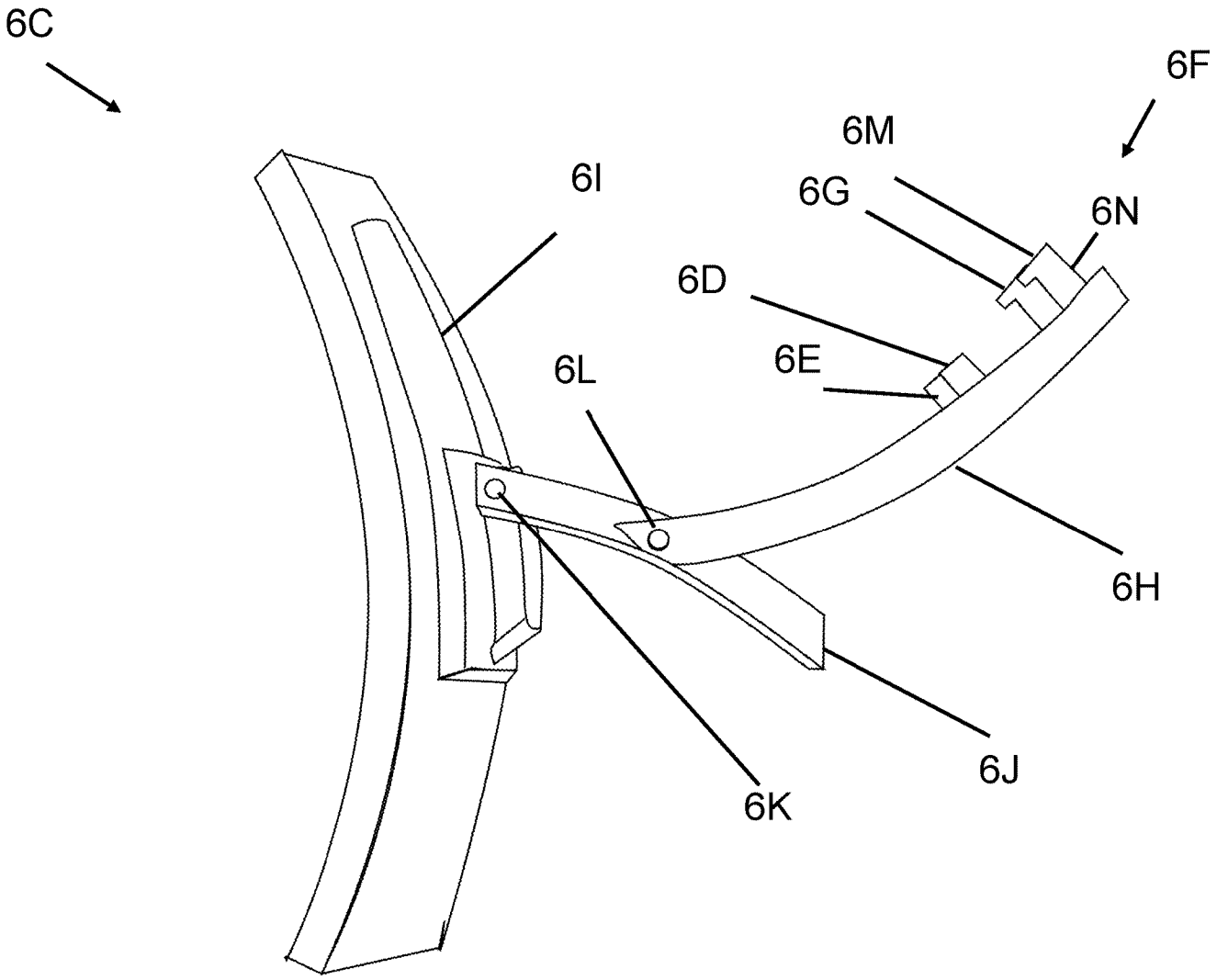
FIG. 6 is a top perspective view of the first toggle buckle of the second component of FIG. 2 in an open state.

Referring now generally to the Figures and particularly to FIG. 6, FIG. 6 is a top perspective view of a toggle buckle 6C in an open state. The pair of registration pins 6D & 6E and the pair of hook-pins 6F & 6G extend from the toggle member 6H. The toggle buckle 6C further comprises an anchor 6I that is coupled with the second rigid piece 6B. The lever arm 6J of the toggle buckle 6C is disposed between and rotatably coupled with both the anchor 6I and the toggle member 6H. A first pin 6K extends through both the anchor 6I and the lever arm 6J and rotatably couples the anchor 6I and the lever arm 6J. A second pin 6L extends through both the toggle member 6H and the lever arm 6J and rotatably couples the toggle member 6H and the lever arm 6J.

Each hook-pin 6F & 6G comprises a full diameter head 6M and a reduced diameter shaft 6N, the reduced diameter shaft 6N extending from the toggle member 6H and to the full diameter head 6M.

Figure 7:
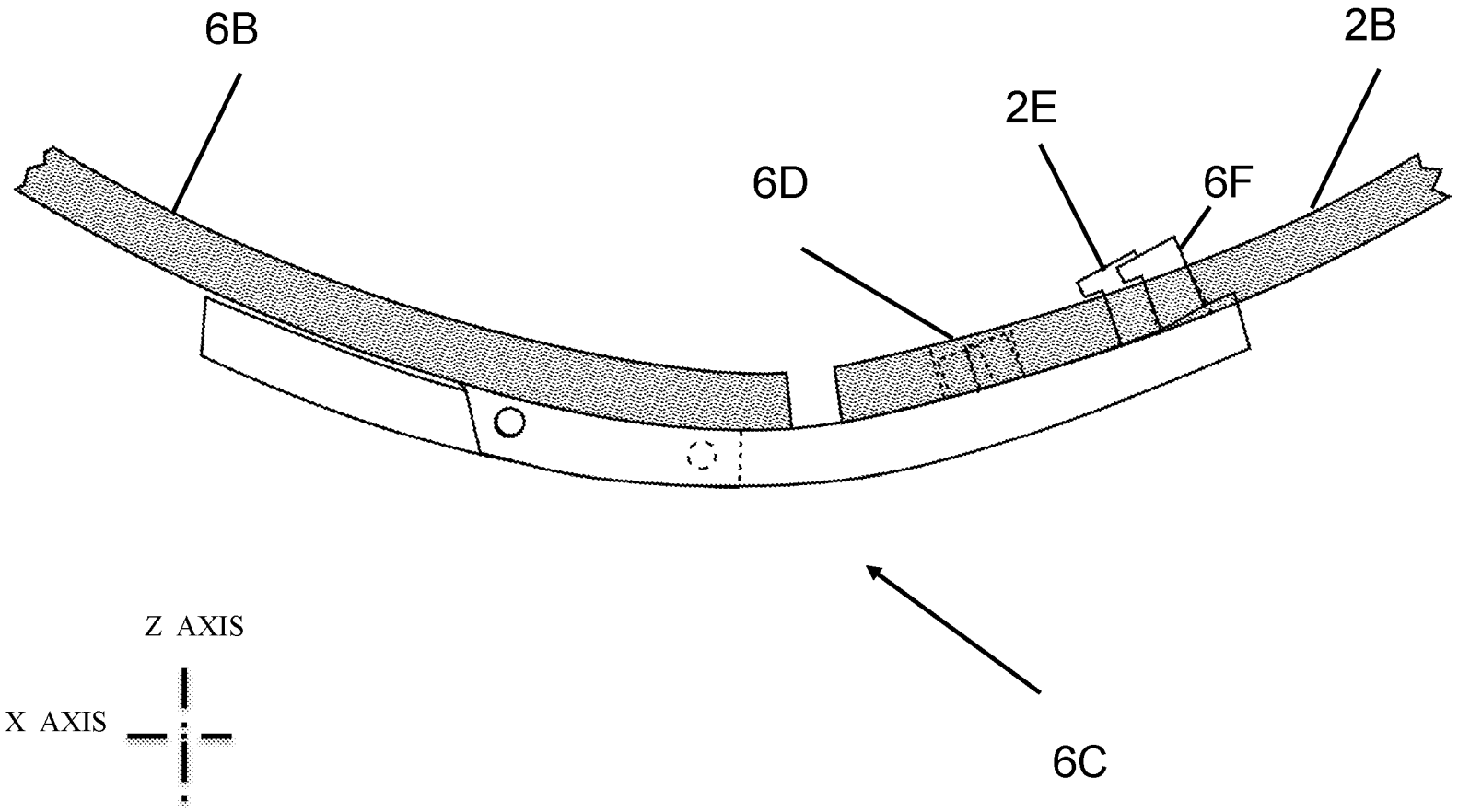
FIG. 7 is a top view of the first toggle buckle of the second component of FIG. 2 engaged with the first component of FIG. 1 and placing the first preferred embodiment into the attached state.

Referring now generally to the Figures and particularly to FIG. 7, FIG. 7 is a top view of the toggle buckle 6C engaged with the first component 2 and placing the first belt 4 into the attached state. The pair of registration pins 6D & 6E each respectively extend into a separate matching registration receiver 2D & 2E; and the pair of hook-pins 6F & 6G each respectively extend fully through a separate matching hook-pin receiver 2F & 2G.

Figure 8:
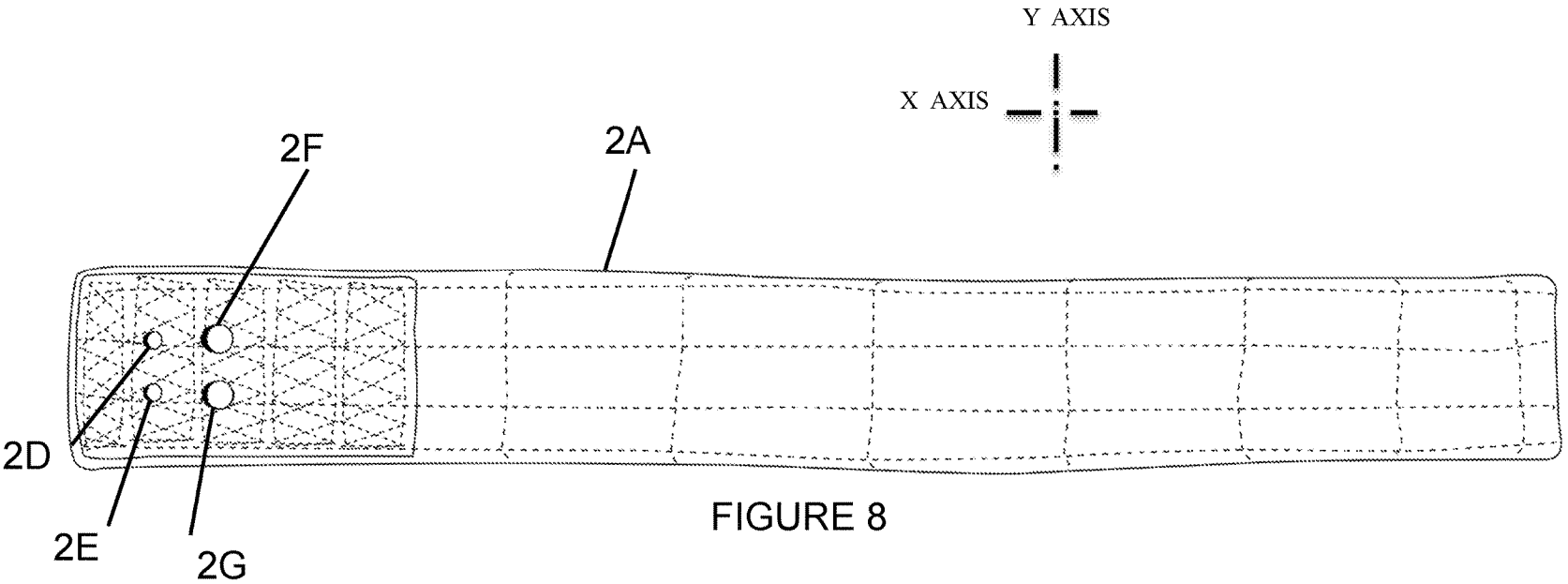
FIG. 8 is a front view of a first fabric length of a second preferred embodiment of invented belt in a detached and isolated state.
Figure 12:
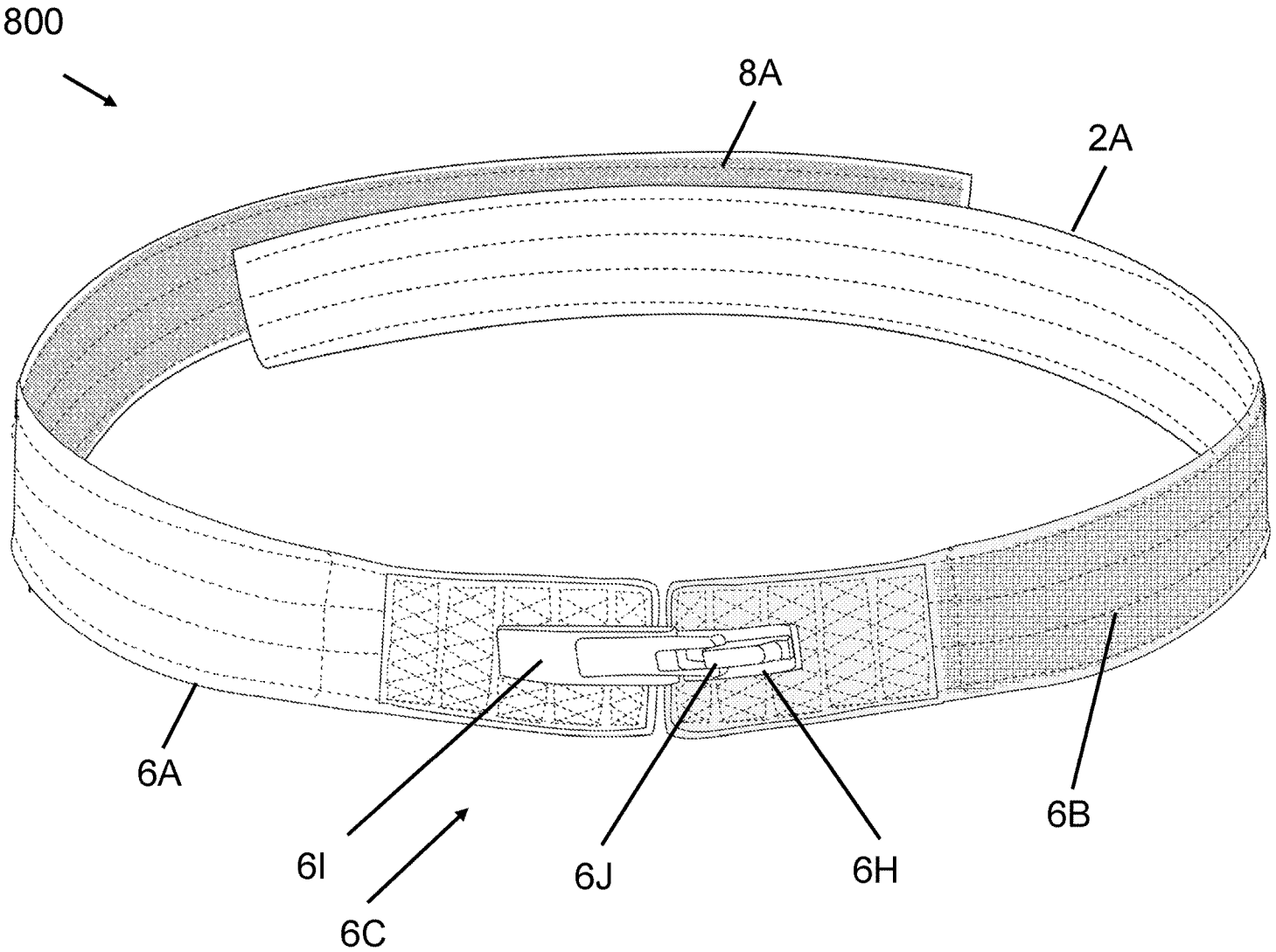
FIG. 12 is a front perspective view of the first preferred embodiment of invented belt with the first fabric length of FIG. 8 and the second fabric length of FIG. 9 formed in an attached state.

Referring now generally to the Figures and particularly to FIG. 8 and FIG. 12, FIG. 8 is a front view of the first fabric length 2A in a detached and isolated state, wherein the first fabric length 2A is an element of a second preferred embodiment of the invented belt 800 (hereinafter, "the second belt" 800) as shown in full FIG. 12.

The second belt 800 does not the first rigid piece 2B. The second belt 800 includes the pair of registration receivers 2D & 2E and the pair of hook-pin receivers 2F & 2G extending fully through the first fabric length 2A.

The outward fastener fabric length 8A extends along the front side second fabric length 6A. It is understood that in various preferred alternate embodiments of the invented belt that the outward fastener fabric length 8A may be or comprise a hook type fastener fabric and/or a loop type fastener fabric.

Figure 9:
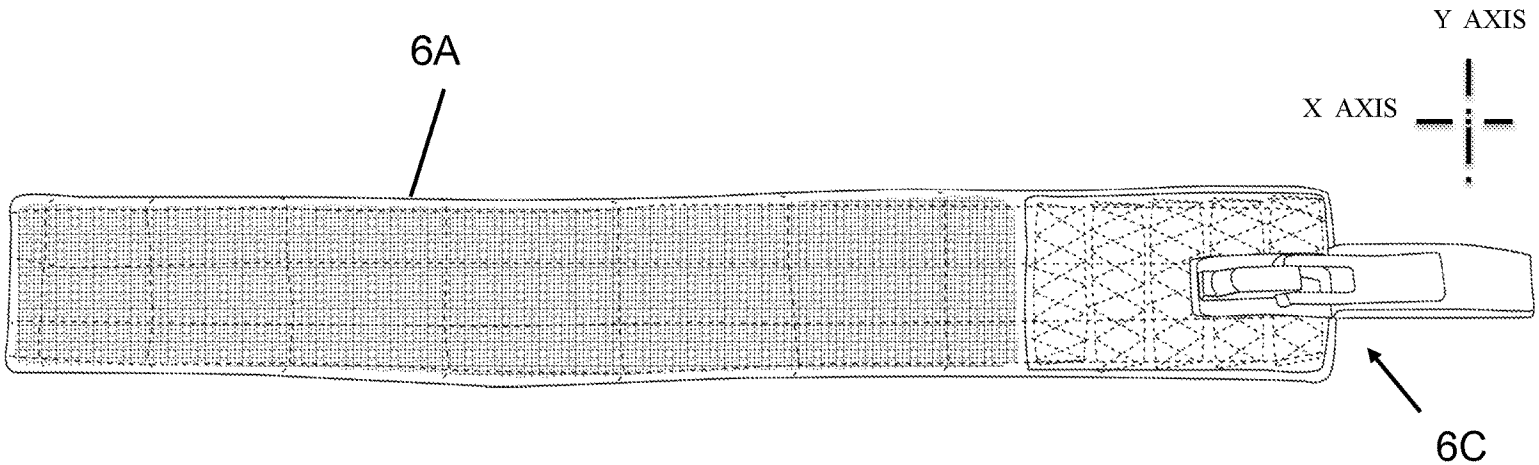
FIG. 9 is a front view of a second fabric length of the second preferred embodiment of invented belt in a detached and isolated state.

Referring now generally to the Figures and particularly to FIG. 9, FIG. 9 is a front view of the second fabric length 6A unattached to second rigid piece 6B. The toggle buckle 6C is preferably directly coupled with the second fabric length 6A. The outward fastener fabric length 8A extends along the front side second fabric length 6A. It is understood that in various preferred alternate embodiments of the invented belt that the outward fastener fabric length 8A may be or comprise a hook type fastener fabric and/or a loop type fastener fabric.

Figure 10:
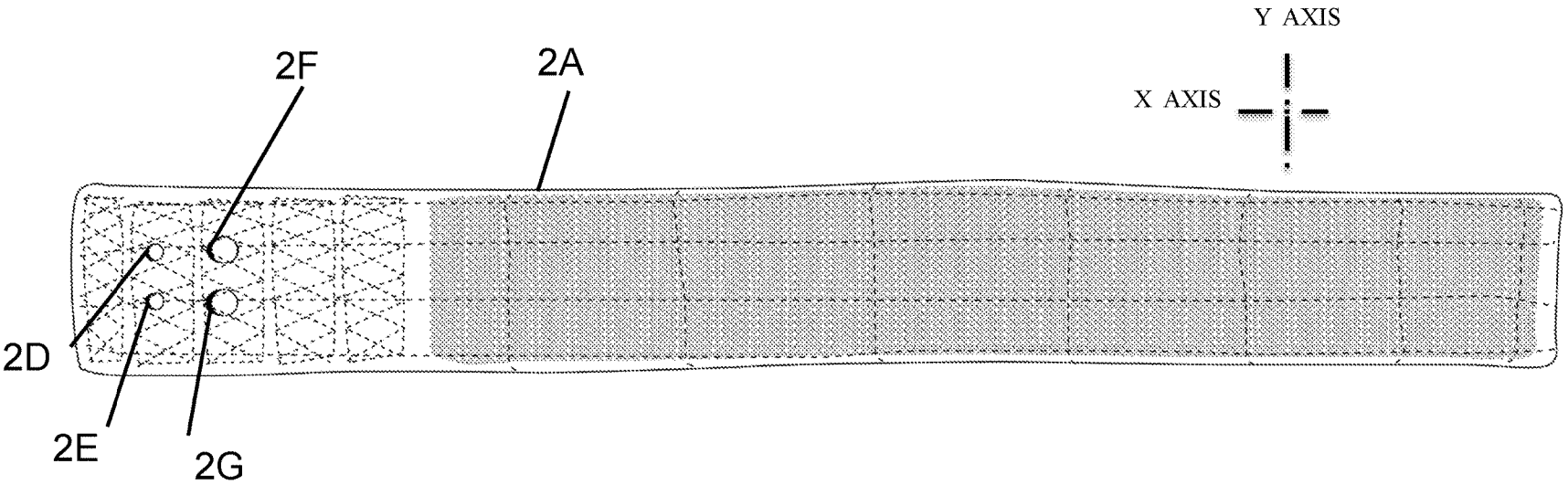
FIG. 10 is a back view of the first fabric length FIG. 8 in a detached and isolated state.

Referring now generally to the Figures and particularly to FIG. 10, FIG. 10 is a back view of the first fabric length 2A in a detached and isolated state. The inward fastener fabric length 8B extends along the back side of the first fabric length 2A. It is understood that in various preferred alternate embodiments of the invented belt that the inward fastener fabric length 8B may be or comprise a hook type fastener fabric and/or a loop type fastener fabric.

Figure 11:
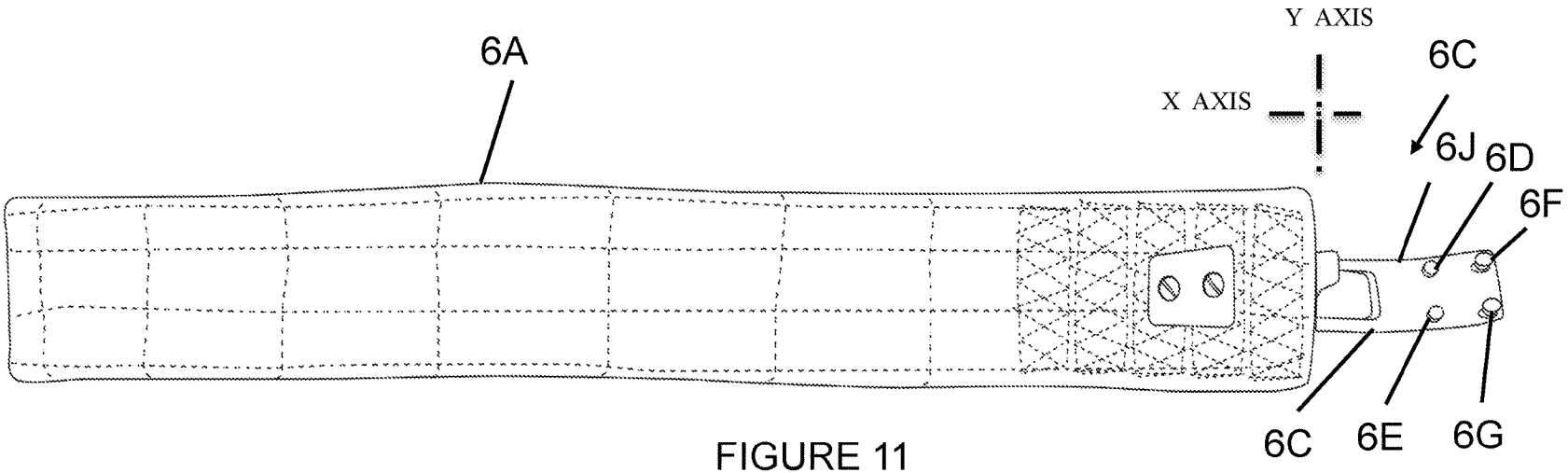
FIG. 11 is a back view of the second fabric length FIG. 9 in a detached and isolated state.

Referring now generally to the Figures and particularly to FIG. 11, FIG. 11 is a back view of the second fabric length 6A in a detached and isolated state. The toggle buckle 6C includes the pair of registration pins 6D & 6E and the pair of hook-pins 6F & 6G that extend from a toggle member 6H. The toggle buckle 6C further comprises an anchor 6I that is coupled with the second rigid piece 6B. The lever arm 6J of the toggle buckle 6C is disposed between and rotatably coupled with both the anchor 6I and the toggle member 6H.

It is understood that the toggle buckle 6C may comprise or be replaced with the toggle means T as disclosed in U.S. Pat. No. 4,541,152 issued to inventors Thomas DiMarco and Joel Di Marco on Sep. 17, 1985 and titled "Quick hook-up and release buckling for weight lifter belts", or other suitable hook-up and release buckling known in the art.

Referring now generally to the Figures and particularly to FIG. 12, FIG. 12 is a front perspective view of the second belt 800 with the first fabric length 2A and the second fabric length 6A formed into an attached state, wherein the toggle buckle 6C is engaged with the first fabric length 2A and the outward fastener fabric length 8A is engaged with and detachably coupled with the inward fastener fabric length 8B.

Figure 13:
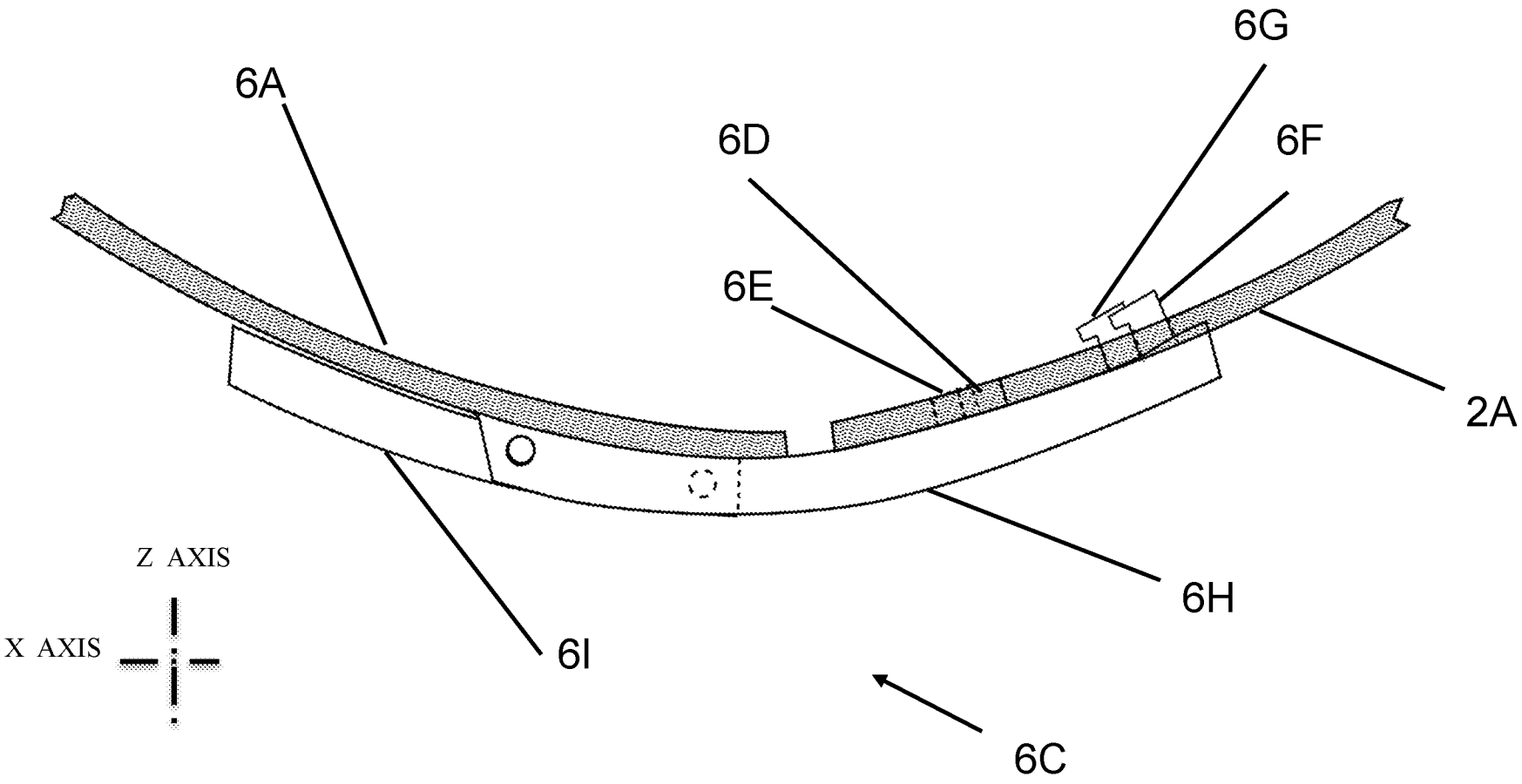
FIG. 13 is a top view of the first toggle buckle of the second fabric length of FIG. 9 engaged with the first fabric length of FIG. 8 and placing the second preferred embodiment into the attached state.

Referring now generally to the Figures and particularly to FIG. 13, FIG. 13 is a top view of the toggle buckle 6C directly coupled with the second fabric length 6B and detachably engaged with the first fabric length 2A of FIG. 10 and placing the second belt 800 into the attached state. The pair of registration pins 6D & 6E of the toggle buckle 6C each respectively extend into a separate matching registration receiver 2D & 2E of the first fabric length 2A; and the pair of hook-pins 6F & 6G each respectively extend fully through a separate matching hook-pin receiver 2F & 2G of the first fabric length 2A.

Figure 14A:
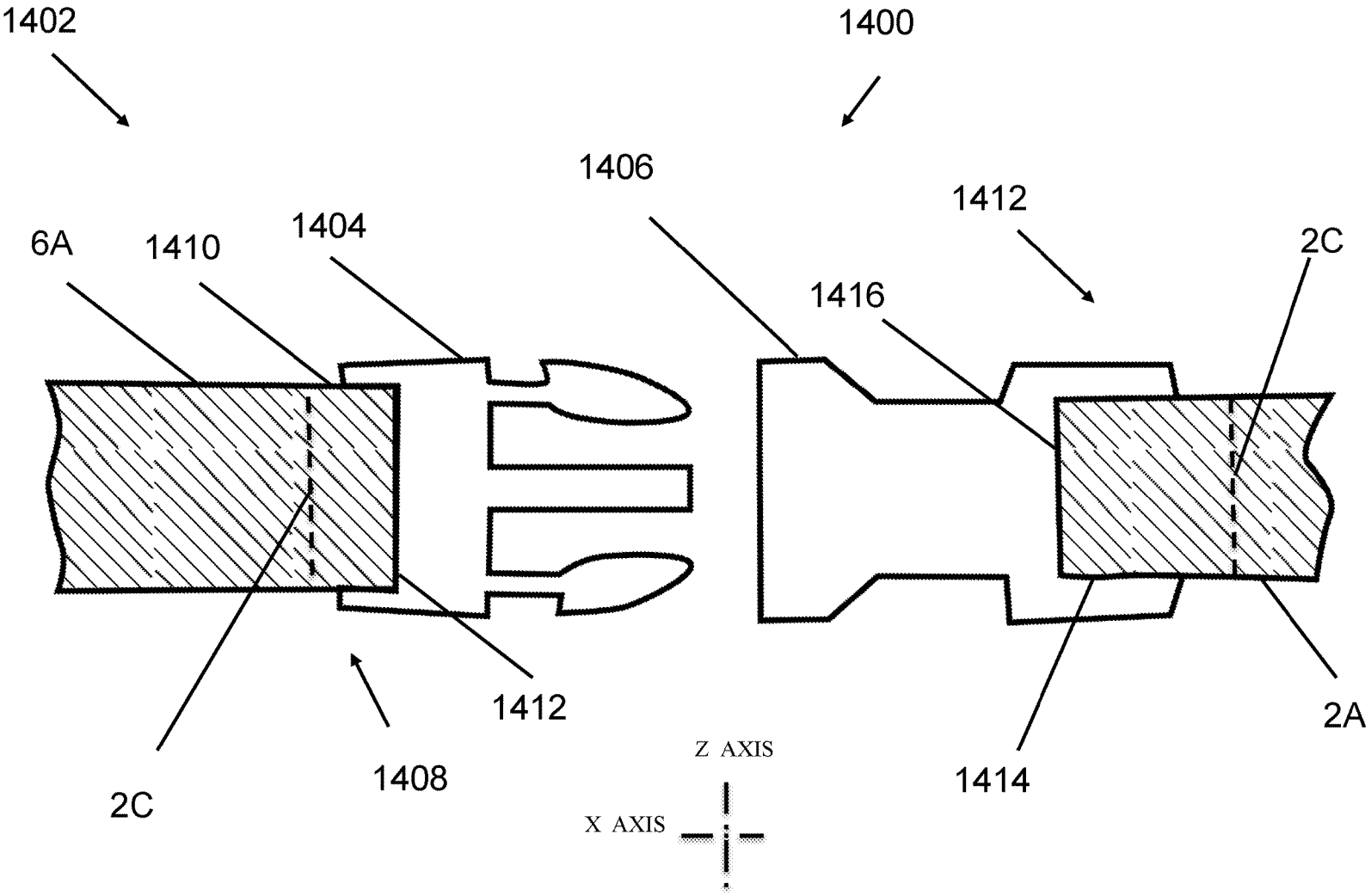
FIG. 14A is a front view of a first alternate buckle assembly integrated into a preferred alternate third embodiment of the present invention and presented in an uncoupled state and replacing the detachable coupling function of the toggle buckle of FIG. 5.

Referring now generally to the Figures and particularly to FIG. 14A, FIG. 14A is a front view of a first alternate buckle assembly 1400 (hereinafter, "the detachable buckle" 1400) integrated into a preferred alternate third embodiment of the present invention 1402 (hereinafter, "the third belt" 1402) and presented in an uncoupled state.

The detachable buckle 1400 is or comprises anyone of a variety of suitable detachable buckles known in the art that include a receiver element 1404 and an insertion element 1406, to include a MOJAVE (™) quick release buckle as marketed by National Molding of Miami Lakes, Fla. or other suitable quick release buckle known in the art.

A first loop 1408 of the third belt 1402 is formed by passing a first end length 1410 of the first fabric length 2A through a first aperture 1412 of the receiver element 1404; the first loop 1408 is thereby formed, closed and durably attached with the receiver element 1404 by sewn thread 2C that passes through the resulting doubled up first fabric length 2A to form the first loop 1408.

A second loop 1412 of the third belt 1402 is formed by passing an additional end length 1414 of the second fabric length 6A through a second aperture 1416 of the insertion element 1406; the second loop 1412 is thereby formed, closed and durably attached with the insertion element 1406 by sewn thread 2C that passes through the resulting doubled up second fabric length 2A to form the second loop 1412.

Figure 14B:
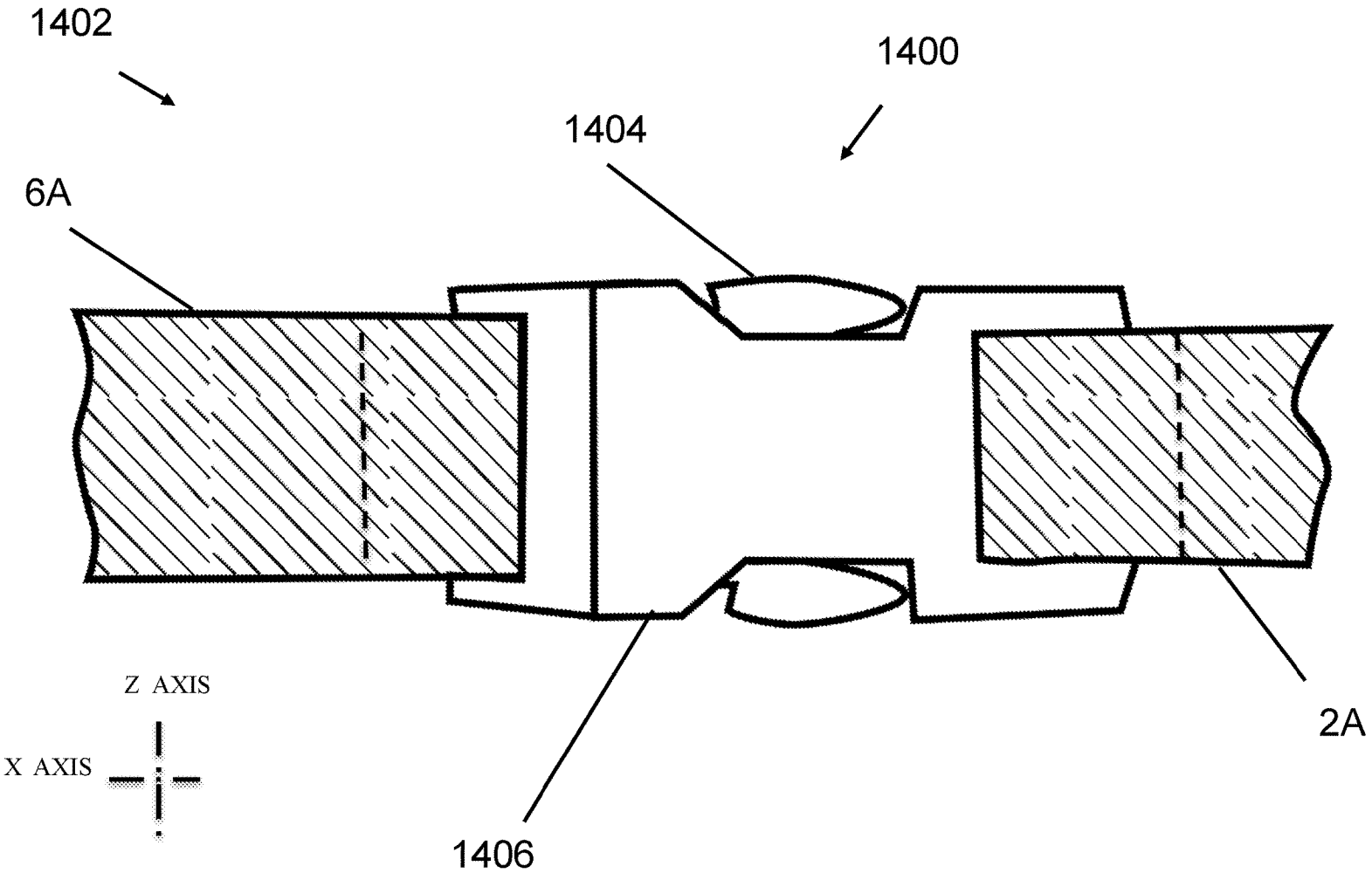
FIG. 14B is a front view of the first alternate buckle assembly integrated into the preferred alternate third embodiment of the present invention of FIG. 14A and presented in an coupled state.

Referring now generally to the Figures and particularly to FIG. 14B, FIG. 14B is a front view of the detachable buckle 1400 and the third belt 1402 presented in a coupled state, wherein the insertion element 1406 is detachably engaged with the receiver element 1404.

Figure 15A:
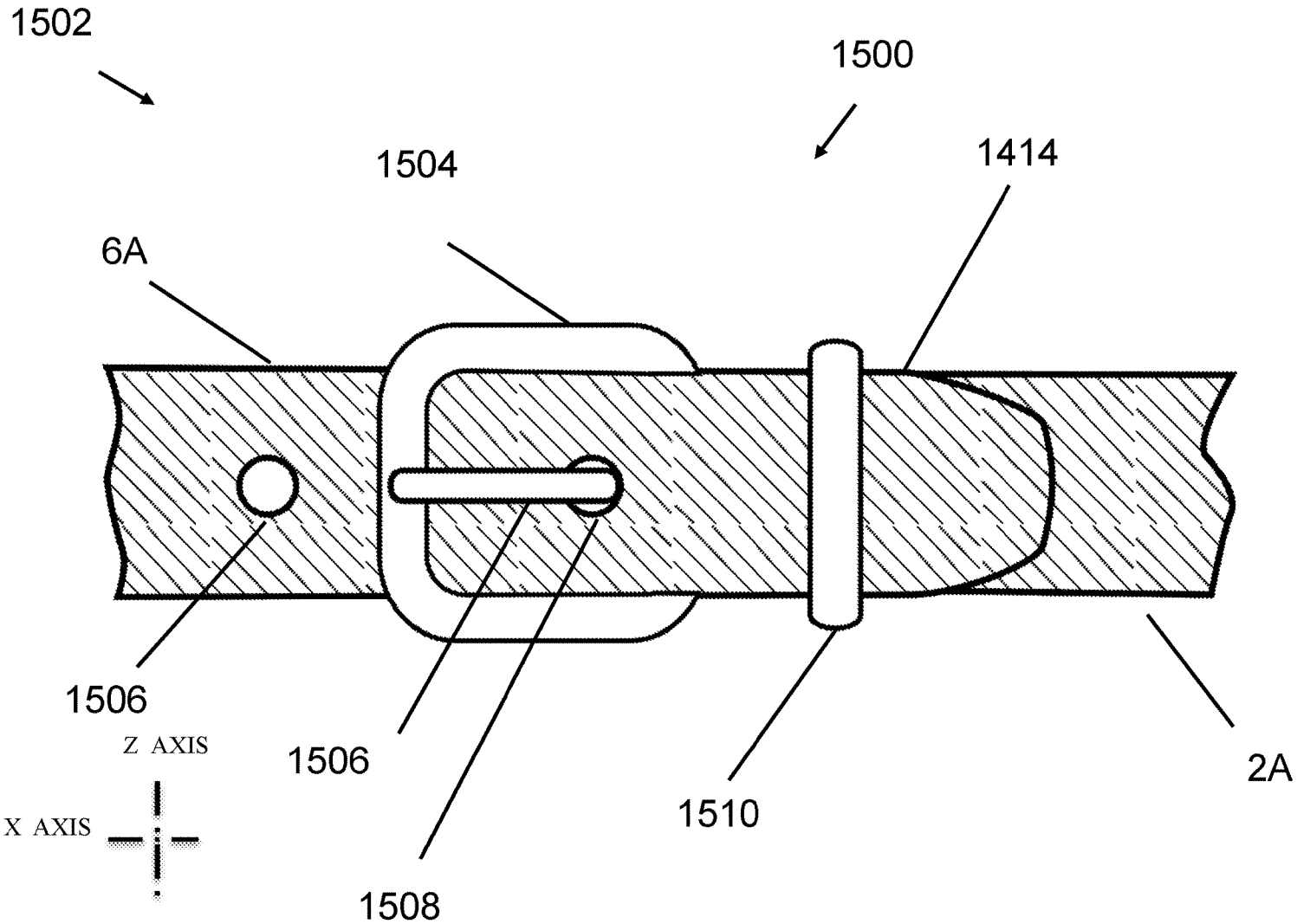
FIG. 15A is a front view of a second alternate buckle assembly integrated into a preferred alternate fourth embodiment of the present invention and presented in a coupled state and replacing the buckling means of FIG. 5.

Referring now generally to the Figures and particularly to FIG. 15A, FIG. 15A is a front view of a second alternate buckle assembly 1500 (hereinafter, "the basic buckle") 1500 integrated into a preferred alternate fourth embodiment of the present invention 1502 (hereinafter, "the fourth belt" 1502) and presented in a coupled state and replacing the function of the toggle buckle 6C. The basic buckle comprises an orthogonal ring 1504 and a tongue 1506, wherein the tongue 1506 is rotatably coupled at a first end to the orthogonal ring 1504. The orthogonal ring 1504 is coupled to the first fabric length 2A by a doubling over of the first end length 1410 by sewn thread 2C that passes through the resulting doubled up first fabric length 2A to durably attach the orthogonal ring 1504 to the first fabric length 2A. In the coupled state of the basic buckle 1500 as shown in FIG. 15, the tongue 1506 extends through a belt hole 1508 of the second fabric length 6A, wherein the second fabric length 6A is preferably pinched and caught between the tongue 1506 and the orthogonal ring 1504 when the fourth belt 1502 is worn by a user in weight lifting actions. An optional securing loop 1510 is durably attached to the first fabric length 2A and receives the second fabric length 6A to prevent the additional end length 1414 from undesirably flopping about while the fourth belt 1502 is worn during weight lifting activity.

Figure 15B:
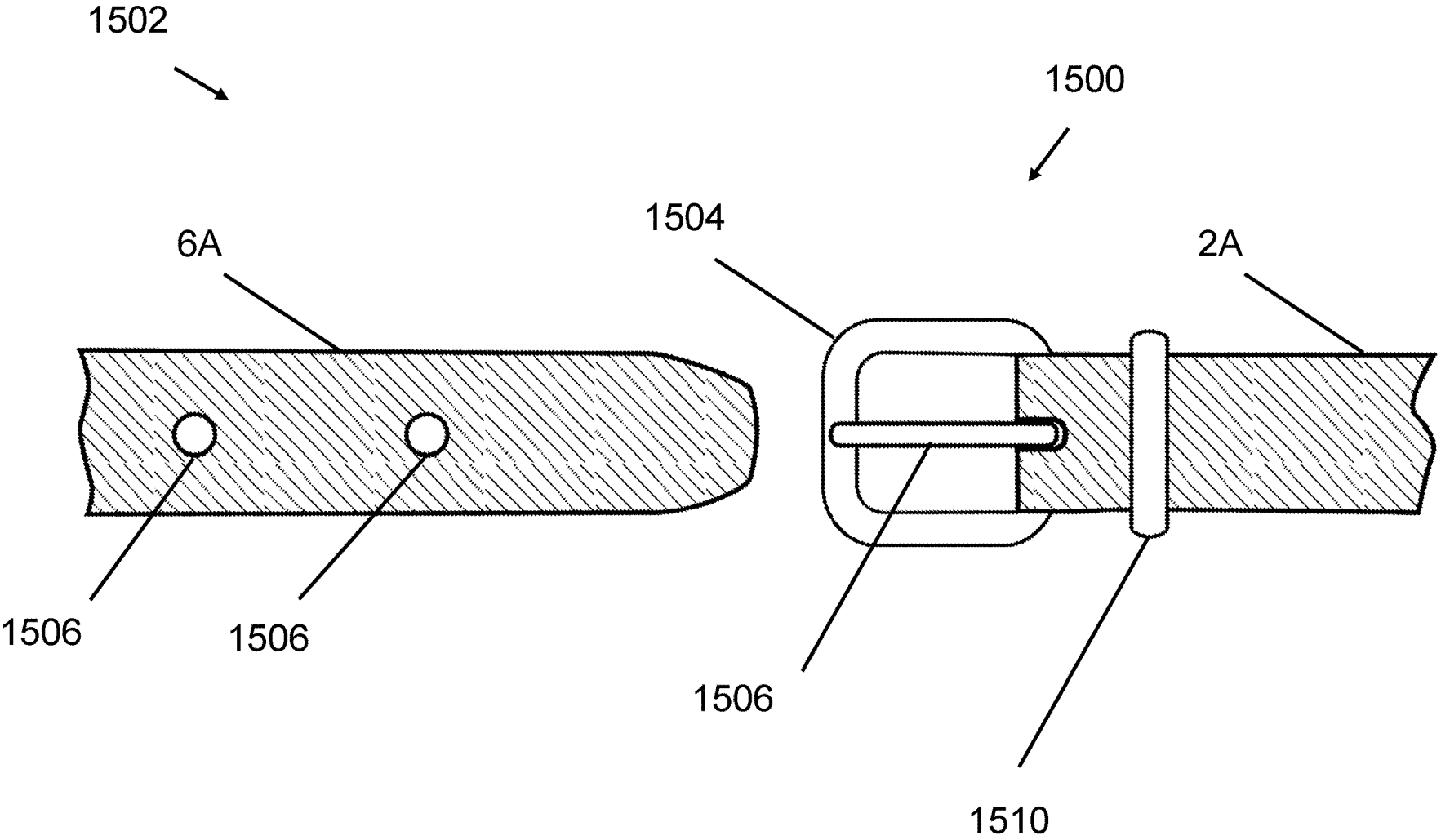
FIG. 15B is a front view of the second alternate buckle assembly of FIG. 15B presented in a decoupled state.

Referring now generally to the Figures and particularly to FIG. 15B, FIG. 15B is a front view of the basic buckle 1500 and the fourth belt 1502 presented in a decoupled state.

It is understood that a wearer of the first belt 4, the second belt 800, the third belt 1402 and the fourth belt 1502 may disengage and remove the belt by separating the outward fastener fabric length 8A from the inward fastener fabric length 8B.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

I claim:

1. A belt alternatively forming a tightened closed condition and an interconnected released condition, the belt including:

a first belt element comprising a first rigid end coupled with a first flexible elongate length, the first elongate length coupled with a first strip of hook and loop fastener fabric, and at least one aperture extending fully through the first rigid end;

a first aperture extending fully through the first rigid end, a second aperture extending fully through the first rigid end, and a first registration aperture extending fully through the first rigid end;

a second belt element comprising a second rigid end coupled with a second flexible elongate length, the second flexible elongate length coupled with a second strip of hook and loop fastener fabric;

a first registration pin extending from the second rigid end and positioned for insertion into the first registration aperture; and a first hook pin extending from the second rigid end and positioned for insertion into the first aperture with the first hook pin fully extending though the first aperture, and a second hook pin extending from the second rigid end and positioned for insertion into the second aperture with the second hook pin fully extending though the second aperture, and a basic buckle assembly, comprising at least a frame and a tongue, coupled to the second rigid end, such that when the basic buckle assembly is detachably engaged with the aperture of the first rigid end by (a) passing the first rigid end through the frame of the basic buckle assembly, (b) threading the tongue of the basic buckle assembly through the aperture of the first rigid end, the second rigid end may be securely coupled with the first rigid end to form a tightened closed condition when the first strip of hook and loop fastener fabric and the second strip of hook and loop fastener fabric are detachably coupled.

2. The belt of claim 1, further comprising:

a second registration aperture extending fully through the first rigid end; and a second registration pin extending from the second end and positioned for insertion into the second registration aperture when the second hook-pin fully extends though the additional aperture.

3. A belt alternatively forming a tightened closed condition and an interconnected released condition, the belt including:

a first belt element comprising a first rigid end coupled with a first flexible elongate length, the first elongate length coupled with a first strip of hook and loop fastener fabric, and a first aperture extending fully through the first rigid end;

a second belt element comprising a second rigid end coupled with a second flexible elongate length, the second elongate length coupled with a second strip of hook and loop fastener fabric;

a toggle buckle comprising an anchor, a lever arm, and a toggle member, the anchor coupled with the second rigid end, the lever arm rotatably coupled with the anchor and further rotatably coupled with the toggle member, and a hook-pin extending from the toggle member, wherein the hook-pin is positioned to detachably extend through and engage the additional aperture to securely couple the toggle member with the first rigid end to form the tightened closed condition when the first strip of hook and loop fastener fabric and the second strip of hook and loop fastener fabric are detachably coupled.

4. The belt of claim 3, further comprising:

a first registration aperture extending fully through the first rigid end; and a first registration pin extending from the toggle member and positioned for insertion into the first registration aperture when the hook-pin fully extends though the first aperture.

5. The belt of claim 4, wherein the wherein the first aperture and the first registration aperture are longitudinally spaced.

6. The belt of claim 3, further comprising:

an additional aperture extending fully through the first rigid end; and a second hook-pin extending from the toggle member and detachably engaging the additional aperture to securely couple the toggle member with the first rigid end to form the tightened closed condition when the first strip of hook and loop fastener fabric and the second strip of hook and loop fastener fabric are detachably coupled.

7. The belt of claim 6, further comprising:

a first registration aperture extending fully through the first rigid end; and a first registration pin extending from the toggle member and positioned for insertion into the first registration aperture when the hook-pin fully extends though the first aperture.

8. The belt of claim 7, further comprising:

a second registration aperture extending fully through the first rigid end; and a second registration pin extending from the toggle end and positioned for insertion into the second registration aperture when the second hook-pin fully extends though the additional aperture.

9. The belt of claim 8, wherein the wherein the first aperture and the first registration aperture are longitudinally spaced.

10. The belt of claim 9, wherein the wherein the hook pin and the first registration pin are longitudinally spaced and positioned to detachably engage with the first aperture and the first registration aperture.

11. The belt of claim 9, wherein the additional aperture and the second registration aperture are longitudinally spaced.

12. The belt of claim 11, wherein the second hook pin and the second registration pin are longitudinally spaced and positioned to detachably engage with the additional aperture and the second registration aperture.

13. The belt of claim 3, wherein the hook-pin comprises a full diameter head and a reduced diameter shaft, the reduced diameter shaft extending from the toggle member and to the full diameter head.

14. The belt of claim 6, wherein the second hook-pin comprises a full diameter head and a reduced diameter shaft, the reduced diameter shaft extending from the toggle member and to the full diameter head.

15. The belt of claim 14, wherein the hook-pin comprises a full diameter head and a reduced diameter shaft, the reduced diameter shaft extending from the toggle member and to the full diameter head.

16. The belt of claim 3, wherein the lever arm comprises a lever arm extension for manual operation of alternative coupling and decoupling of the toggle member and the first rigid end.

17. The belt of claim 3, wherein a rotatable attachment feature of the lever arm with the toggle member is disposed between the lever arm extension and the rotatable attachment of the lever arm and the anchor.

18. A belt alternatively forming a tightened closed condition and an interconnected released condition, the belt including:

a first belt element comprising a first rigid end coupled with a first flexible elongate length, the first elongate length coupled with a first strip of hook and loop fastener fabric, and a first slide release buckle side extending from the first rigid end;

a first registration aperture extending fully through the first rigid end, a first aperture extending fully through the first rigid end, and a second aperture extending fully through the first rigid end; and a second belt element comprising a second rigid end coupled with a second flexible elongate length, the second elongate length coupled with a second strip of hook and loop fastener fabric, and a second slide release buckle side extending from the second rigid end;

a first registration pin extending from the second rigid end and positioned for insertion into the first registration aperture when the first registration pin extends into the first registration aperture a first hook pin extending from the second rigid end and positioned for insertion into the second aperture with the first hook pin fully extending though the first aperture, and a second hook pin extending from the second rigid end and positioned for insertion into the third aperture with the first hook pin fully extending though the second aperture, and means for detachably engaging the first slide release buckle side with the second slide release buckle side and securely couple the second rigid end with the first rigid end to form a tightened closed condition when the first strip of hook and loop fastener fabric and the second strip of hook and loop fastener fabric are detachably coupled.

* * * * *